US010645517B1

(12) United States Patent
Ramirez Flores et al.

(10) Patent No.: US 10,645,517 B1
(45) Date of Patent: May 5, 2020

(54) TECHNIQUES TO OPTIMIZE MICROPHONE AND SPEAKER ARRAY BASED ON PRESENCE AND LOCATION

(71) Applicant: Lenovo (Singapore) Pte. Ltd., Singapore (SG)

(72) Inventors: Axel Ramirez Flores, Cary, NC (US); Russell Speight VanBlon, Raleigh, NC (US); Jonathan Jen-Wei Yu, Raleigh, NC (US); Rodrigo Felix de Almeida, Raleigh, NC (US); Jonathan Co Lee, Cary, NC (US); James A. Hunt, Chapel Hill, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 16/369,348

(22) Filed: Mar. 29, 2019

(51) Int. Cl.

| | |
|---|---|
| ***H04S 7/00*** | (2006.01) |
| ***H04R 5/04*** | (2006.01) |
| ***H04R 5/027*** | (2006.01) |
| ***H04R 5/02*** | (2006.01) |
| ***G10L 21/0208*** | (2013.01) |
| ***H04R 3/04*** | (2006.01) |

(52) U.S. Cl.
CPC ..... *H04S 7/303* (2013.01); *G10L 21/0208* (2013.01); *H04R 3/04* (2013.01); *H04R 5/02* (2013.01); *H04R 5/027* (2013.01); *H04R 5/04* (2013.01); *H04R 2410/01* (2013.01); *H04R 2430/01* (2013.01); *H04S 2400/13* (2013.01); *H04S 2420/01* (2013.01)

(58) Field of Classification Search
CPC .. H04S 7/303; H04S 2400/13; H04S 2420/01; G10L 21/0208; H04R 3/04; H04R 5/02; H04R 5/027; H04R 5/04; H04R 2410/01; H04R 2430/01
See application file for complete search history.

(56) References Cited

U.S. PATENT DOCUMENTS

| | | | | |
|---|---|---|---|---|
| 8,208,664 | B2 * | 6/2012 | Iwasaki | H04M 3/56 379/202.01 |
| 9,774,896 | B2 * | 9/2017 | Clavenna | H04N 21/2187 |
| 10,034,111 | B1 * | 7/2018 | Barbier | H04R 29/004 |
| 2015/0078581 | A1 * | 3/2015 | Etter | H04M 3/568 381/92 |
| 2018/0005632 | A1 * | 1/2018 | Mann | H04R 1/32 |

OTHER PUBLICATIONS

"ClearOne Beamforming Microphone Array 2-microphone", CDW, retrieved Mar. 21, 2019 from https://www.cdw.com/product/ClearOne-Beamforming-Microphone-Array-2-microphone/4398765?cm_cat=google&cm_ite=4398765&cm_pla=NA-NA-Clearone_TP&cm_ven=acquirgy&ef_id=CjwKCAjwqqrmBRAAEiwAdpDXtNxPjiKCKaEQ9FGgDx5w3D7SEahSa_gNPWpZIRT0F4OGkxJ_sKkU2RoCCS4QAvD_BwE:G:.

"ClearOne "Beamformer" Microphone demonstration", PAVT, Youtube, published Jan. 9, 2019, retrieved from https://www.youtube.com/watch?v=Bepqav87D40.

* cited by examiner

*Primary Examiner* — Andrew L Sniezek

(74) *Attorney, Agent, or Firm* — John M. Rogitz; John L. Rogitz

(57) ABSTRACT

In one aspect, an apparatus includes a processor and an array of plural microphones and/or an array of plural speakers. Storage accessible to the processor includes instructions executable by the processor to establish a setting of at least one element in at least one of the arrays based at least in part on a signal from at least one proximity sensor.

20 Claims, 4 Drawing Sheets

TECHNIQUES TO OPTIMIZE MICROPHONE AND SPEAKER ARRAY BASED ON PRESENCE AND LOCATION

FIELD

The present application relates to technically inventive, non-routine solutions that are necessarily rooted in computer technology and that produce concrete technical improvements.

BACKGROUND

As recognized herein, microphone arrays for conference room solutions generically attempt to identify sound direction for their adaptive intelligence. As also understood herein, a problem with that solution is that the microphone array has no way to know where the participants really are to focus the microphone array beaming towards the participants, instead relying only on the direction of sound, which may be reflected from walls and thus which may not accurately model the location of the participants.

SUMMARY

Accordingly, in one aspect an apparatus includes a processor and an array of plural microphones and/or an array of plural speakers. Storage accessible to the processor includes instructions executable by the processor to establish a setting of at least one element in at least one of the arrays based at least in part on a signal from at least one proximity sensor.

In some embodiments, the at least one proximity sensor may include an infrared (IR) sensor and/or a camera. At least one of the arrays may be circular, and/or at least one of the arrays may be linear. Additionally, the apparatus may include the array of microphones and/or the array of speakers.

Additionally, in some embodiments the instructions may be executable to establish a gain of at least a first microphone in the array of microphones at least in part responsive to a determination based at least in part on the signal from the proximity sensor that the first microphone is a closest microphone in the array of microphones to a first participant, who may be a speaking participant.

The instructions may also be executable to input at least one signal from at least a first microphone in the array of microphones to noise cancelation circuitry at least in part responsive to a determination based at least in part on the signal from the proximity sensor that the first microphone is not a closest microphone in the array of microphones to a first participant.

Still further, the instructions may be executable to deenergize at least a first microphone in the array of microphones at least in part responsive to a determination based at least in part on the signal from the proximity sensor that the first microphone is not a closest microphone in the array of microphones to a first participant. Additionally or alternatively, the instructions may be executable to deenergize at least a first speaker in the array of speakers at least in part responsive to a determination based at least in part on the signal from the proximity sensor that the first speaker is not a closest speaker in the array of speakers to a first participant.

Also in some embodiments, the instructions may be executable to establish a gain of at least a first speaker in the array of speakers at least in part responsive to a determination based at least in part on the signal from the proximity sensor that the first speaker is a closest speaker in the array of speakers to a first participant.

Additionally or alternatively, the instructions may be executable to deenergize at least a first speaker in the array of speakers at least in part responsive to a determination based at least in part on the signal from the proximity sensor that the first speaker is a closest speaker in the array of speakers to an obstruction, and/or to deenergize at least a first microphone in the array of microphones at least in part responsive to a determination based at least in part on the signal from the proximity sensor that the first microphone is a closest microphone in the array of microphones to an obstruction.

Further, in some embodiments the instructions may be executable to identify that a speaking participant is a first distance from the apparatus based at least in part on a first signal from the proximity sensor, establish a first gain of at least one microphone in the array of microphones based at least in part on identifying that the speaking participant is the first distance from the apparatus, identify that the speaking participant is a second distance from the apparatus based at least in part on a second signal from the proximity sensor, and establish a second gain of at least one microphone in the array of microphones based at least in part on identifying that the speaking participant is the second distance from the apparatus, where the first distance may be greater than the second distance and where the first gain may be greater than the second gain.

In another aspect, a method includes imaging plural participants in a room, and identifying at least one of the participants as a speaking participant. The method also includes, based at least in part on identifying the speaking participant, increasing a gain of at least a first microphone in an array of microphones based on the first microphone in the array of microphones being a closest microphone in the array of microphones to the speaking participant.

In another aspect, a device includes at least one computer storage that is not a transitory signal and that in turn includes instructions executable by at least one processor to establish a gain of at least a first microphone in an array of microphones at least in part responsive to a determination based at least in part on a signal from the proximity sensor that the first microphone is a closest microphone in the array of microphones to a first participant. The instructions also are executable to input at least one signal from at least a second microphone in the array of microphones to noise cancelation circuitry at least in part responsive to a determination based at least in part on the signal from the proximity sensor that the second microphone is not a closest microphone in the array of microphones to the first participant.

The details of present principles, both as to their structure and operation, can best be understood in reference to the accompanying drawings, in which like reference numerals refer to like parts, and in which:

DETAILED DESCRIPTION

Figure 1:
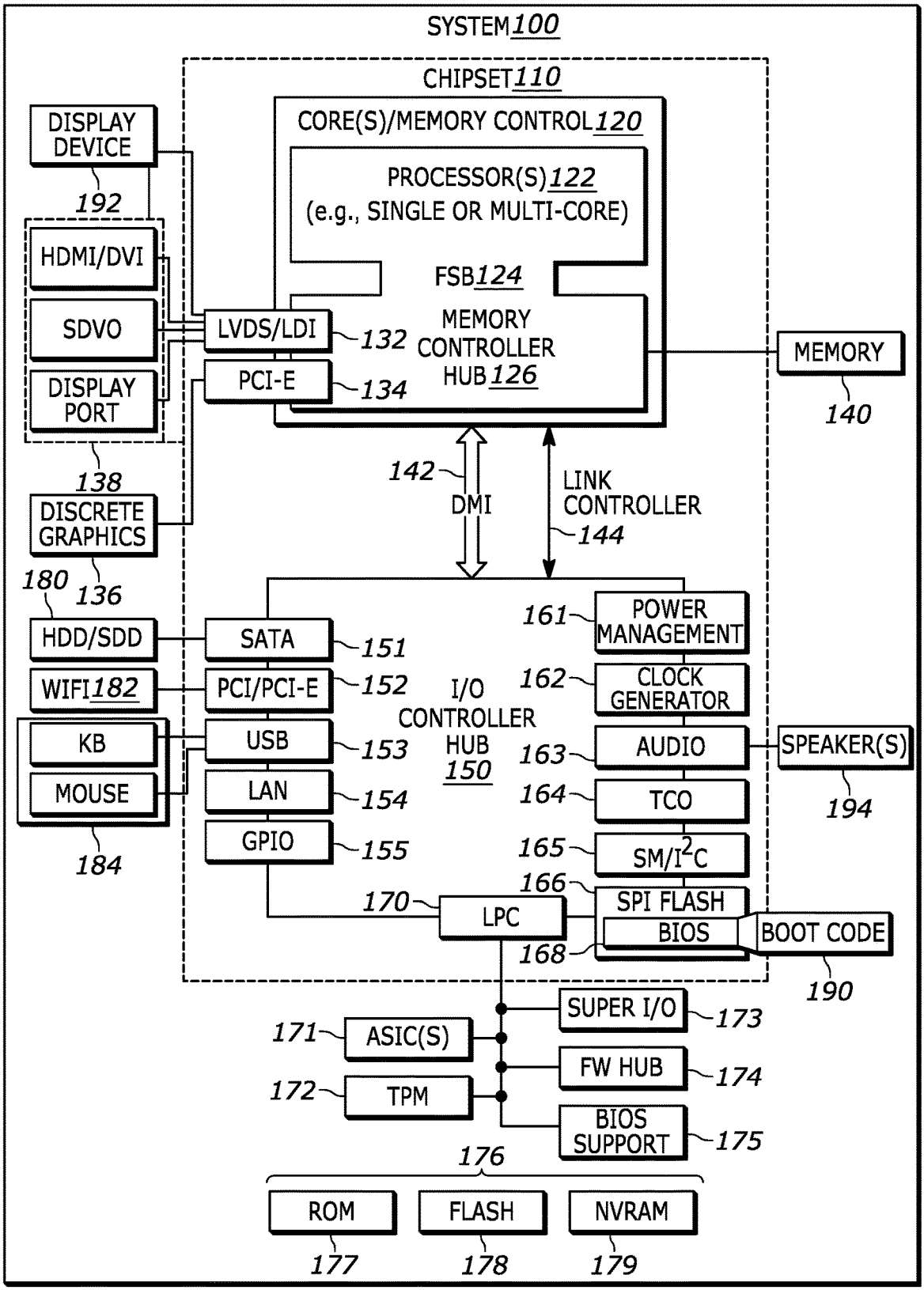
FIG. 1 is a block diagram of an example system in accordance with present principles.

The above problem is solved by techniques described herein that optimize directionality of a microphone array using presence detection and location awareness of the participants.

With respect to any computer systems discussed herein, a system may include server and client components, connected over a network such that data may be exchanged between the client and server components. The client components may include one or more computing devices including televisions (e.g., smart TVs, Internet-enabled TVs), computers such as desktops, laptops and tablet computers, so-called convertible devices (e.g., having a tablet configuration and laptop configuration), and other mobile devices including smart phones. These client devices may employ, as non-limiting examples, operating systems from Apple Inc. of Cupertino Calif., Google Inc. of Mountain View, Calif., or Microsoft Corp. of Redmond, Wash. A Unix® or similar such as Linux® operating system may be used. These operating systems can execute one or more browsers such as a browser made by Microsoft or Google or Mozilla or another browser program that can access web pages and applications hosted by Internet servers over a network such as the Internet, a local intranet, or a virtual private network.

As used herein, instructions refer to computer-implemented steps for processing information in the system. Instructions can be implemented in software, firmware or hardware, or combinations thereof and include any type of programmed step undertaken by components of the system; hence, illustrative components, blocks, modules, circuits, and steps are sometimes set forth in terms of their functionality.

A processor may be any general purpose single- or multi-chip processor that can execute logic by means of various lines such as address lines, data lines, and control lines and registers and shift registers. Moreover, any logical blocks, modules, and circuits described herein can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can also be implemented by a controller or state machine or a combination of computing devices. Thus, the methods herein may be implemented as software instructions executed by a processor, suitably configured application specific integrated circuits (ASIC) or field programmable gate array (FPGA) modules, or any other convenient manner as would be appreciated by those skilled in those art. Where employed, the software instructions may also be embodied in a non-transitory device that is being vended and/or provided that is not a transitory, propagating signal and/or a signal per se (such as a hard disk drive, CD ROM or Flash drive). The software code instructions may also be downloaded over the Internet. Accordingly, it is to be understood that although a software application for undertaking present principles may be vended with a device such as the system 100 described below, such an application may also be downloaded from a server to a device over a network such as the Internet.

Software modules and/or applications described by way of flow charts and/or user interfaces herein can include various sub-routines, procedures, etc. Without limiting the disclosure, logic stated to be executed by a particular module can be redistributed to other software modules and/or combined together in a single module and/or made available in a shareable library.

Logic when implemented in software, can be written in an appropriate language such as but not limited to C # or C++, and can be stored on or transmitted through a computer-readable storage medium (that is not a transitory, propagating signal per se) such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

The term "circuit" or "circuitry" may be used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

Now specifically in reference to FIG. 1, an example block diagram of an information handling system and/or computer system 100 is shown that is understood to have a housing for the components described below. Note that in some embodiments the system 100 may be a desktop computer system, such as one of the ThinkCentre® or ThinkPad® series of personal computers sold by Lenovo (US) Inc. of Morrisville, N.C., or a workstation computer, such as the ThinkStation®, which are sold by Lenovo (US) Inc. of Morrisville, N.C.; however, as apparent from the description herein, a client device, a server or other machine in accordance with present principles may include other features or only some of the features of the system 100. Also, the system 100 may be, e.g., a game console such as XBOX®, and/or the system 100 may include a mobile communication device such as a mobile telephone, notebook computer, and/or other portable computerized device.

As shown in FIG. 1, the system 100 may include a so-called chipset 110. A chipset refers to a group of integrated circuits, or chips, that are designed to work together.

Chipsets are usually marketed as a single product (e.g., consider chipsets marketed under the brands INTEL®, AMD®, etc.).

In the example of FIG. 1, the chipset 110 has a particular architecture, which may vary to some extent depending on brand or manufacturer. The architecture of the chipset 110 includes a core and memory control group 120 and an I/O controller hub 150 that exchange information (e.g., data, signals, commands, etc.) via, for example, a direct management interface or direct media interface (DMI) 142 or a link controller 144. In the example of FIG. 1, the DMI 142 is a chip-to-chip interface (sometimes referred to as being a link between a "northbridge" and a "southbridge").

The core and memory control group 120 include one or more processors 122 (e.g., single core or multi-core, etc.) and a memory controller hub 126 that exchange information via a front side bus (FSB) 124. As described herein, various components of the core and memory control group 120 may be integrated onto a single processor die, for example, to make a chip that supplants the "northbridge" style architecture.

The memory controller hub 126 interfaces with memory 140. For example, the memory controller hub 126 may provide support for DDR SDRAM memory (e.g., DDR, DDR2, DDR3, etc.). In general, the memory 140 is a type of random-access memory (RAM). It is often referred to as "system memory."

The memory controller hub 126 can further include a low-voltage differential signaling interface (LVDS) 132. The LVDS 132 may be a so-called LVDS Display Interface (LDI) for support of a display device 192 (e.g., a CRT, a flat panel, a projector, a touch-enabled light emitting diode display or other video display, etc.). A block 138 includes some examples of technologies that may be supported via the LVDS interface 132 (e.g., serial digital video, HDMI/DVI, display port). The memory controller hub 126 also includes one or more PCI-express interfaces (PCI-E) 134, for example, for support of discrete graphics 136. Discrete graphics using a PCI-E interface has become an alternative approach to an accelerated graphics port (AGP). For example, the memory controller hub 126 may include a 16-lane (x16) PCI-E port for an external PCI-E-based graphics card (including, e.g., one of more GPUs). An example system may include AGP or PCI-E for support of graphics.

In examples in which it is used, the I/O hub controller 150 can include a variety of interfaces. The example of FIG. 1 includes a SATA interface 151, one or more PCI-E interfaces 152 (optionally one or more legacy PCI interfaces), one or more USB interfaces 153, a LAN interface 154 (more generally a network interface for communication over at least one network such as the Internet, a WAN, a LAN, etc. under direction of the processor(s) 122), a general purpose I/O interface (GPIO) 155, a low-pin count (LPC) interface 170, a power management interface 161, a clock generator interface 162, an audio interface 163 (e.g., for speakers 194 to output audio), a total cost of operation (TCO) interface 164, a system management bus interface (e.g., a multi-master serial computer bus interface) 165, and a serial peripheral flash memory/controller interface (SPI Flash) 166, which, in the example of FIG. 1, includes BIOS 168 and boot code 190. With respect to network connections, the I/O hub controller 150 may include integrated gigabit Ethernet controller lines multiplexed with a PCI-E interface port. Other network features may operate independent of a PCI-E interface.

The interfaces of the I/O hub controller 150 may provide for communication with various devices, networks, etc. For example, where used, the SATA interface 151 provides for reading, writing or reading and writing information on one or more drives 180 such as HDDs, SDDs or a combination thereof, but in any case the drives 180 are understood to be, e.g., tangible computer readable storage mediums that are not transitory, propagating signals. The I/O hub controller 150 may also include an advanced host controller interface (AHCI) to support one or more drives 180. The PCI-E interface 152 allows for wireless connections 182 to devices, networks, etc. The USB interface 153 provides for input devices 184 such as keyboards (KB), mice and various other devices (e.g., cameras, phones, storage, media players, etc.).

In the example of FIG. 1, the LPC interface 170 provides for use of one or more ASICs 171, a trusted platform module (TPM) 172, a super 1/O 173, a firmware hub 174, BIOS support 175 as well as various types of memory 176 such as ROM 177, Flash 178, and non-volatile RAM (NVRAM) 179. With respect to the TPM 172, this module may be in the form of a chip that can be used to authenticate software and hardware devices. For example, a TPM may be capable of performing platform authentication and may be used to verify that a system seeking access is the expected system.

The system 100, upon power on, may be configured to execute boot code 190 for the BIOS 168, as stored within the SPI Flash 166, and thereafter processes data under the control of one or more operating systems and application software (e.g., stored in system memory 140). An operating system may be stored in any of a variety of locations and accessed, for example, according to instructions of the BIOS 168.

Additionally, though not shown for simplicity, in some embodiments the system 100 may include a gyroscope that senses and/or measures the orientation of the system 100 and provides input related thereto to the processor 122, as well as an accelerometer that senses acceleration and/or movement of the system 100 and provides input related thereto to the processor 122. Still further, the system 100 may include an audio receiver/microphone that provides input from the microphone to the processor 122 based on audio that is detected, such as via a user providing audible input to the microphone, and a camera that gathers one or more images and provides input related thereto to the processor 122. The camera may be a thermal imaging camera, an infrared (IR) camera, a digital camera such as a webcam, a three-dimensional (3D) camera, and/or a camera otherwise integrated into the system 100 and controllable by the processor 122 to gather pictures/images and/or video. Also, the system 100 may include a GPS transceiver that is configured to communicate with at least one satellite to receive/identify geographic position information and provide the geographic position information to the processor 122. However, it is to be understood that another suitable position receiver other than a GPS receiver may be used in accordance with present principles to determine the location of the system 100.

It is to be understood that an example client device or other machine/computer may include fewer or more features than shown on the system 100 of FIG. 1. In any case, it is to be understood at least based on the foregoing that the system 100 is configured to undertake present principles.

Figure 2:
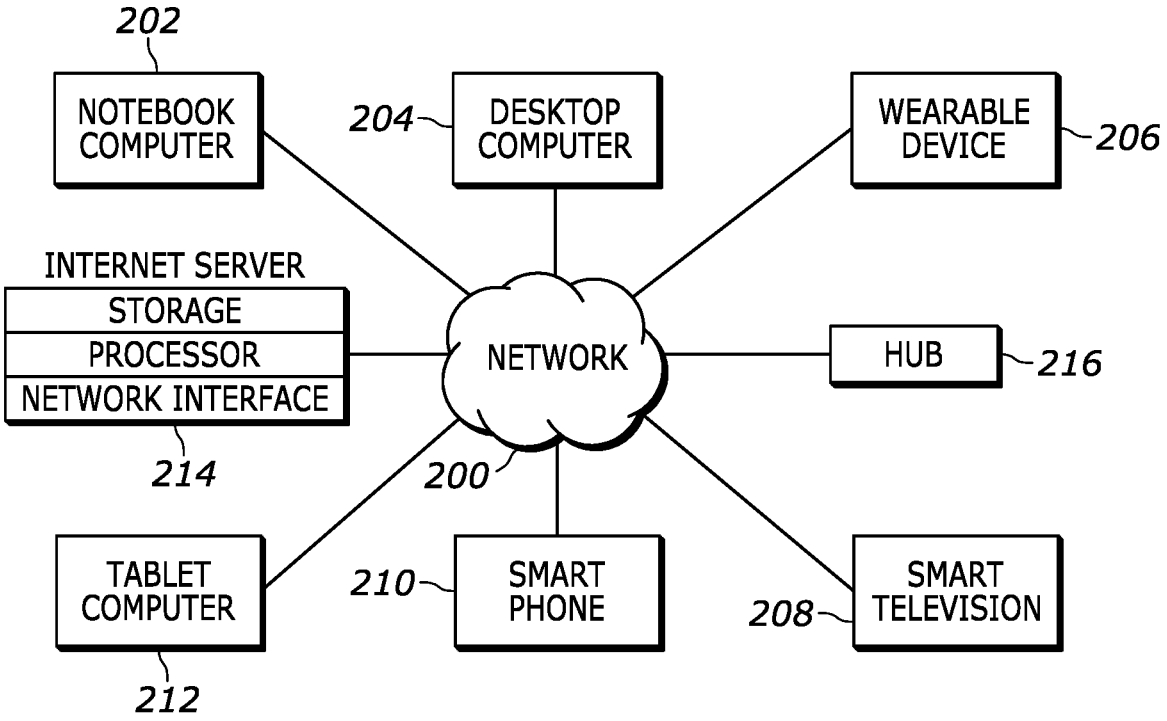
FIG. 2 is a block diagram of an example network of devices in accordance with present principles.

Turning now to FIG. 2, example devices are shown communicating over a network 200 such as the Internet in accordance with present principles. It is to be understood that each of the devices described in reference to FIG. 2 may include at least some of the features, components, and/or elements of the system 100 described above. Indeed, any of the devices disclosed herein may include at least some of the features, components, and/or elements of the system 100 described above.

FIG. 2 shows a notebook computer and/or convertible computer 202, a desktop computer 204, a wearable device 206 such as a smart watch, a smart television (TV) 208, a smart phone 210, a tablet computer 212, and a server 214 such as an Internet server that may provide cloud storage accessible to the devices 202-212. A hub computing device 2016 also may be provided. It is to be understood that the devices 202-216 are configured to communicate with each other over the network 200 to undertake present principles, and that the hub 216 may be directly connected to one or more of the devices shown in FIG. 2.

Figure 3:
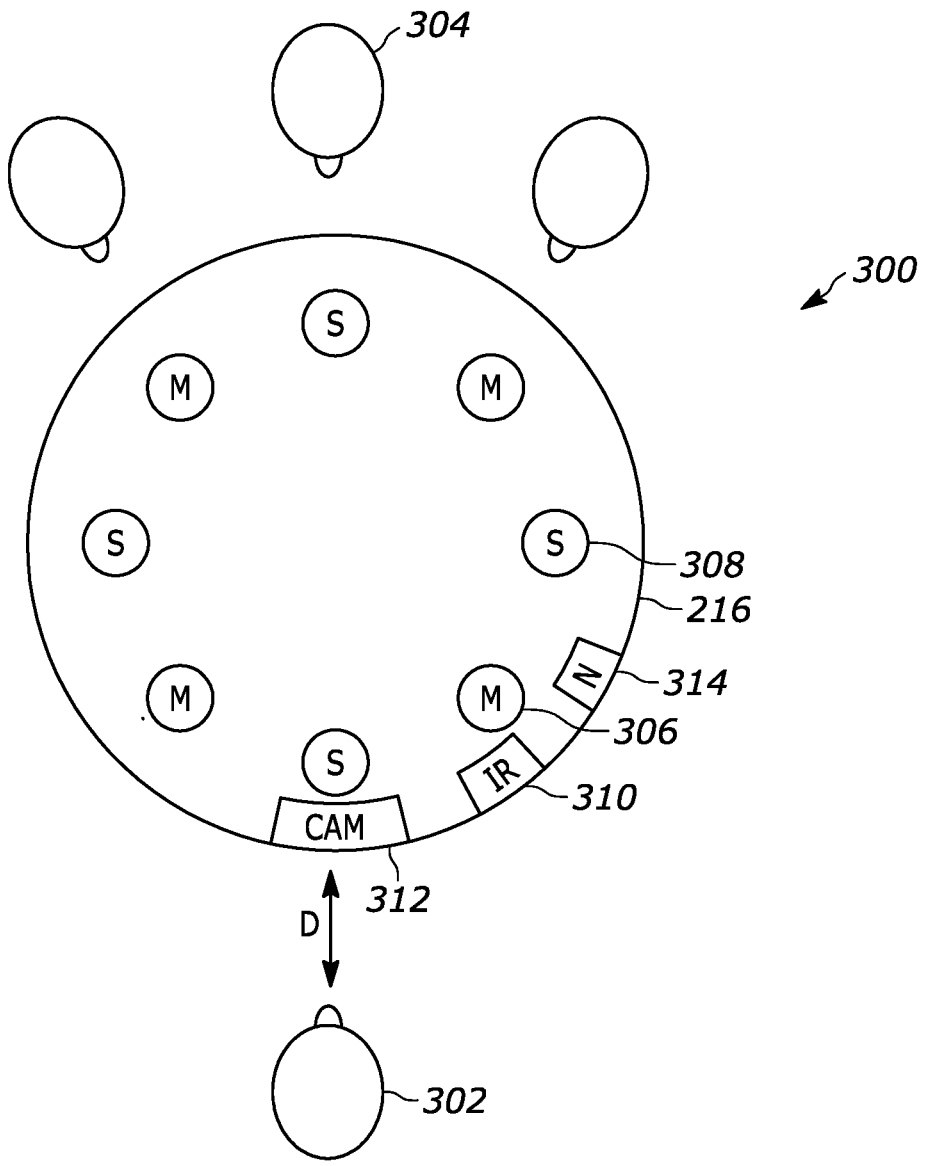
FIG. 3 is a schematic diagram showing an example implementation in a conference room with multiple participants.

FIG. 3 illustrates an example implementation of a microphone and/or speaker array 300 implemented by the hub 216, it being understood that other implementations are contemplated. It is to be further understood that the hub 216, in addition to the components shown in FIG. 3, incorporates appropriate components shown and described above, including processors, computer storages, transceivers, displays, and input devices.

Assume the hub 300 is in a room with plural teleconference participants, including, for description purposes, a speaking participant 302 and plural listening participants 304 located at respective distances "D" from the hub 216 at respective azimuthal bearings from the hub as shown.

In the example shown, the hub 216 includes an array of microphones 306 arranged in a circle and an array of speakers 308 also arranged in a circle. Other array arrangements are contemplated, e.g., linear. In the example shown, the microphones 306 and speakers 308 all lie on the same circle, i.e., are all the same distance from the central axis of the hub 216, and a microphone 306 is azimuthally between each speaker 308 and the adjacent speakers 308. Likewise, a speaker 308 is azimuthally between each microphone 306 and the adjacent microphones 306. It is to be understood that the speakers 308 may be in a separate circle from the microphones 306 and in any case may be vertically offset from the microphones 306 or may lie in the same vertical plane as the microphones 306.

The hub 216 may also include one or more person sensors or proximity sensors to sense the locations of the participants 302, 304. In the example, the hub 216 can include one or more infrared (IR) proximity sensors 310 and one or more still or video cameras 312. A noise cancelation circuit 314 also may be provided for purposes to be shortly disclosed. An IR proximity sensor 310 can send a signal to a processor in the hub 216 or in the cloud or in a nearby computing apparatus representing the bearing of sensed IR signals from the sensor 310, which can be assumed to be the bearings of the participants 302, 304. The magnitude of each IR signal can be correlated to the respective distances "D" at which the participants 302, 304 are located from the hub 216, with distance being correlated by setting it proportional to one over the square root of the magnitude to account for spherical spreading loss.

In addition or alternatively, both bearing and distance to each participant 302, 304 may be determined using image recognition on images from the camera 312. Moreover, using image recognition it can be determined which participant is speaking and which are not.

Figure 4:
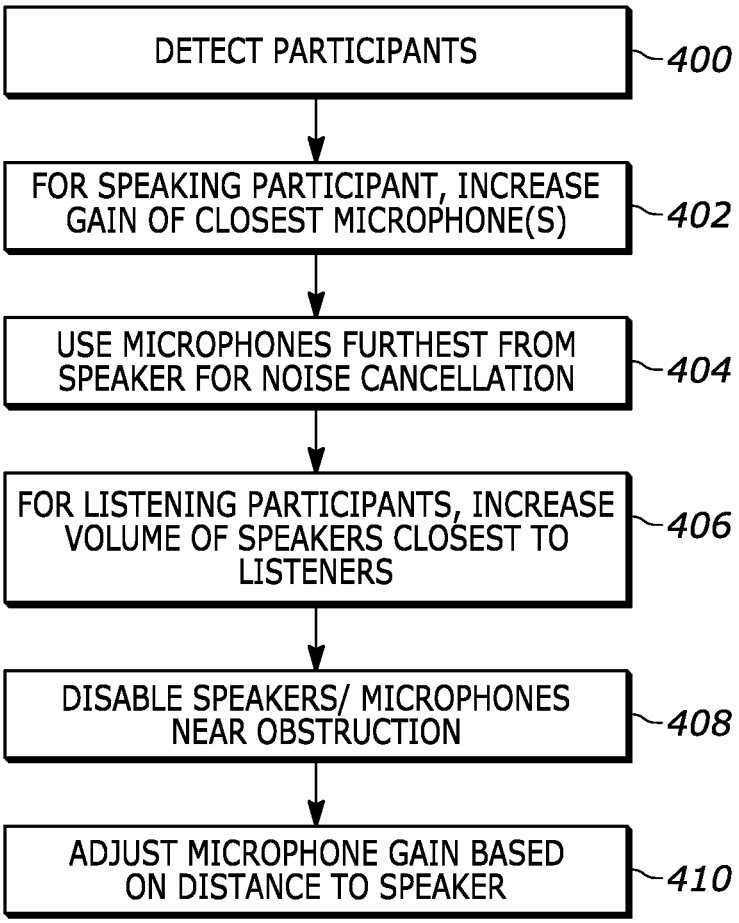
FIG. 4 is a flow chart of example logic consistent with present principles.

Now referring to FIG. 4, at block 400 the participants 302, 304 are detected by one or more of the sensors of the array (in the example of FIG. 3, the hub 216). The hub processing circuitry is programmed with the locations of its speakers 308 and microphones 306, and so by locating the distance and bearing to each participant, the array knows which speaker(s) 308 and microphone(s) 306 are located closest to each participant. In this way, the amplification gain of microphone(s) 306 closest to speaking participants 302 can be automatically increased at block 402.

On the other hand, moving to block 404, if desired the signals from microphone(s) 306 that are opposite to the speaking participant 302 can be automatically be used for noise-cancellation by inputting those signals to the noise-cancelation circuit 314, to suppress noise from the side of the array that is opposite the speaking participant 302. The signals from these microphones can help the system understand the "noise" sound that is occurring in the room (the "audio footprint") so the system can tailor noise cancellation appropriately. U.S. Pat. No. 9,922,635, owned by the present assignee and incorporated herein by reference, provides a non-limiting example illustration for noise cancelation that may use the signals from microphone(s) 306 that are opposite to the speaking participant 302. Note that alternatively, microphone(s) 306 that are opposite to the speaking participant 302 may be automatically deenergized for power/resource savings.

Moving to block 406, the volume of speaker(s) 308 that are closest to listening speakers 304 may be automatically increased based on the person detection at block 400. Furthermore, proceeding to block 408 obstructions in the room such as walls or certain furniture may be detected by, e.g., image recognition and microphone(s) 306 and/or speaker(s) 308 nearest the obstruction disabled to divert resources to unobstructed speakers and/or microphones. In such a case, if desired the speaker(s) 308 and microphone(s)306 that are not near (e.g., within a threshold distance of) any obstruction can automatically be supplied with more power from the resources saved by deenergizing other microphones/speakers. This can result in sending all audio to only a subset of speakers 308 on an unobstructed side of a room as well as acquiring all input voice signals from only a subset of microphones 306 closest to one side of the room.

Block 410 indicates that microphone sensitivity may be adjusted based on distances "D" that each participant is from the array. Thus, for instance, the sensitivity or gain of the microphone 306 closest to the speaking participant 302 may be relatively high when the distance "D" of the speaking participant 302 is relatively large, whereas if the speaking participant 302 moves closer to the array to lesser distance "D", in response the sensitivity or gain of the microphone 306 closest to the speaking participant 302 may be relatively lower.

The hub 216 may store participant positions/distances for quicker adjustment next time that a participant speaks, using this as the "base setting" for a user in that same direction. Note that the base setting may be continuously adjusted if participants move around the space closer or further from the array.

Additionally, in some embodiments a graphical user interface (GUI) may be presented on a display of one of the devices disclosed herein. The GUI may be a GUI for configuring settings of a device operating in accordance with present principles. For example, the GUI may include a first option that is selectable via a check box to configure or enable a device to undertake the logic of FIG. 4 and/or perform other functions disclosed herein.

Note that while certain figures illustrate logic in flow chart format, state logic or other equivalent logic may be used.

It may now be appreciated that present principles provide for an improved computer-based user interface that improves the functionality and ease of use of the devices disclosed herein. The disclosed concepts are rooted in computer technology for computers to carry out their functions.

It is to be understood that whilst present principals have been described with reference to some example embodiments, these are not intended to be limiting, and that various alternative arrangements may be used to implement the subject matter claimed herein. Components included in one embodiment can be used in other embodiments in any appropriate combination. For example, any of the various components described herein and/or depicted in the Figures may be combined, interchanged or excluded from other embodiments.

What is claimed is:

1. An apparatus, comprising:

at least one processor;

an array of plural microphones and an array of plural speakers;

storage accessible to the at least one processor and comprising instructions executable by the at least one processor to:

establish a setting of at least one element in at least one of the arrays based at least in part on at least one signal from at least one proximity sensor; and one or more of:

(a) input at least one signal from at least a first microphone in the array of microphones to noise cancelation circuitry at least in part responsive to a determination based at least in part on at least one signal from the at least one proximity sensor that the first microphone is not a closest microphone in the array of microphones to a first participant;

(b) deenergize at least a first speaker in the array of speakers at least in part responsive to a determination based at least in part on at least one signal from the at least one proximity sensor that the first speaker is a closest speaker in the array of speakers to an obstruction; and/or (c) deenergize at least a second microphone in the array of microphones at least in part responsive to a determination based at least in part on at least one signal from the at least one proximity sensor that the second microphone is a closest microphone in the array of microphones to an obstruction.

2. The apparatus of claim 1, wherein the at least one proximity sensor comprises an infrared (IR) sensor.

3. The apparatus of claim 1, wherein the at least one proximity sensor comprises a camera.

4. The apparatus of claim 1, wherein the instructions are executable to:

establish a gain of at least a third microphone in the array of microphones at least in part responsive to a determination based at least in part on at least one signal from the at least one proximity sensor that the third microphone is a closest microphone in the array of microphones to a second participant.

5. The apparatus of claim 1, wherein the instructions are executable to:

establish a gain of at least a third microphone in the array of microphones at least in part responsive to a determination based at least in part on at least one signal from the at least one proximity sensor that the third microphone is a closest microphone in the array of microphones to a speaking participant.

6. The apparatus of claim 1, wherein the instructions are executable to:

input at least one signal from at least the first microphone in the array of microphones to noise cancelation circuitry at least in part responsive to the determination based at least in part on at least one signal from the at least one proximity sensor that the first microphone is not a closest microphone in the array of microphones to the first participant.

7. The apparatus of claim 1, wherein the instructions are executable to:

deenergize at least a third microphone in the array of microphones at least in part responsive to a determination based at least in part on at least one signal from the at least one proximity sensor that the third microphone is not a closest microphone in the array of microphones to second participant.

8. The apparatus of claim 1, wherein the instructions are executable to:

deenergize at least a second speaker in the array of speakers at least in part responsive to a determination based at least in part on at least one signal from the at least one proximity sensor that the second speaker is not a closest speaker in the array of speakers to a second participant.

9. The apparatus of claim 1, wherein the instructions are executable to:

establish a gain of at least a second speaker in the array of speakers at least in part responsive to a determination based at least in part on at least one signal from the at least one proximity sensor that the second speaker is a closest speaker in the array of speakers to a second participant.

10. The apparatus of claim 1, wherein the instructions are executable to:

deenergize at least the first speaker in the array of speakers at least in part responsive to the determination based at least in part on at least one signal from the at least one proximity sensor that the first speaker is a closest speaker in the array of speakers to an obstruction.

11. The apparatus of claim 1, wherein the instructions are executable to:

deenergize at least the second microphone in the array of microphones at least in part responsive to the determination based at least in part on at least one signal from the at least one proximity sensor that the second microphone is a closest microphone in the array of microphones to an obstruction.

12. The apparatus of claim 1, wherein the instructions are executable to:

identify, based at least in part on a first signal from the at least one proximity sensor, that a speaking participant is a first distance from the apparatus;

based at least in part on identifying that the speaking participant is the first distance from the apparatus, establish a first gain of at least one microphone in the array of microphones;

identify, based at least in part on a second signal from the at least one proximity sensor, that the speaking participant is a second distance from the apparatus; and based at least in part on identifying that the speaking participant is the second distance from the apparatus, establish a second gain of at least one microphone in the array of microphones, the first distance being greater than the second distance, the first gain being greater than the second gain.

13. The apparatus of claim 1, wherein the first microphone and the second microphone are the same microphone.

14. A method, comprising:

receiving one or more signals from at least one proximity sensor on an apparatus, the apparatus comprising an array of microphones; and one or more of:

(a) inputting at least one signal from at least a first microphone in the array of microphones to noise cancelation circuitry at least in part responsive to determining based at least in part on at least one signal from the at least one proximity sensor that the first microphone is not a closest microphone in the array of microphones to a person; and/or (b) deenergizing at least a second microphone in the array of microphones at least in part responsive to determining based at least in part on at least one signal from the at least one proximity sensor that the second microphone is a closest microphone in the array of microphones to an obstruction.

15. The method of claim 14, wherein the first microphone and the second microphone are different microphones.

16. The method of claim 14, wherein the apparatus comprises an array of speakers, and wherein the method comprises:

deenergizing at least a first speaker in the array of speakers at least in part responsive to determining based at least in part on at least one signal from the at least one proximity sensor that the first speaker is a closest speaker in the array of speakers to an obstruction.

17. A device, comprising:

at least one computer storage that is not a transitory signal and that comprises instructions executable by at least one processor to:

establish a gain of at least a first microphone in an array of microphones at least in part responsive to a determination based at least in part on a first signal from at least one proximity sensor that the first microphone is a closest microphone in the array of microphones to a first participant; and input at least one signal from at least a second microphone in the array of microphones to noise cancelation circuitry at least in part responsive to a determination based at least in part on a second signal from the at least one proximity sensor that the second microphone is not a closest microphone in the array of microphones to the first participant.

18. The device of claim 17, wherein the first and second signals from the at least one proximity sensor are the same signal.

19. The device of claim 17, wherein the instructions are executable to:

deenergize at least a first speaker in an array of speakers at least in part responsive to a determination based at least in part on a third signal from the at least one proximity sensor that the first speaker is a closest speaker in the array of speakers to an obstruction.

20. The device of claim 17, wherein the instructions are executable to:

deenergize at least a third microphone in the array of microphones at least in part responsive to a determination based at least in part on a third signal from the at least one proximity sensor that the third microphone is a closest microphone in the array of microphones to an obstruction.

* * * * *